US005430899A

United States Patent [19]

Chisholm

[11] Patent Number: 5,430,899

[45] Date of Patent: Jul. 11, 1995

[54] TRANSITION CRIB FOR INFANTS AND TODDLERS

[76] Inventor: John H. Chisholm, 850 NE. 123rd St., North Miami, Fla. 33161

[21] Appl. No.: 153,828

[22] Filed: Nov. 16, 1993

[51] Int. Cl.[6] ..... A47D 7/00; A47D 7/04

[52] U.S. Cl. ..... 5/95; 5/2.1; 5/93.1; 16/35 R

[58] Field of Search ..... 5/2.1, 93.1, 93.2, 95, 5/100; 16/35 R

[56] References Cited

U.S. PATENT DOCUMENTS

| | | | |
|---|---|---|---|
| 1,322,616 | 11/1919 | Rece | 5/95 |
| 2,077,569 | 4/1957 | Kish | 16/35 R |
| 3,409,105 | 11/1968 | Clinton | 16/35 R |
| 3,628,214 | 12/1971 | Mackay | 16/35 |
| 3,634,894 | 1/1972 | Harbison | 5/93.1 X |
| 5,148,561 | 9/1992 | Tharalson et al. | 5/95 |
| 5,172,435 | 12/1992 | Griffin et al. | 5/95 |
| 5,293,655 | 3/1994 | VanWinkle et al. | 5/95 |

*Primary Examiner*—Michael F. Trettel
*Attorney, Agent, or Firm*—Malloy & Malloy

[57] ABSTRACT

A crib having a headboard, a foot board, and opposite side gates surrounding a horizontal mattress support platform adjustably attached to the headboard and foot board and being selectively positionable at various levels. One of the side gates is removable to facilitate placement of the child crib alongside a parents' bed such that the mattresses on the bed and the crib are disposed in adjacent, co-planar relation. An apron attached to the mattress support platform is extendable for insertion in sandwiched relation between the mattress and a mattress support of the parents' bed, effectively interconnecting the crib and bed while preventing objects such as baby bottles from falling therebetween. A wheel assembly and brake structure associated therewith may be added so that movement of the crib may be selectively accomplished while inadvertent movement or travel of the crib is prevented.

17 Claims, 3 Drawing Sheets

TRANSITION CRIB FOR INFANTS AND TODDLERS

BACKGROUND OF THE INVENTION

1. Field of the Invention

The present invention relates to a child crib specifically structured to accommodate the various stages of child growth and development from infant through the toddler ages.

2. Description of the Related Art

As a child matures from the infant stage through the toddler stage, the specific needs of the child and level of attentive care demanded of the parents slowly diminishes. At the earliest stages, from birth to six months of age, an infant requires the highest degree of care. For this reason, it is advisable that the infant sleep in the same room with the parents to immediately alert the parents of the need for feeding, changing of diapers, or comforting the infant. Many parents prefer to keep their child as close and as accessible to them as possible so that they can attend to their baby without having to get out of bed and walk across the room. On the other hand, it is not advisable to place an infant in bed with adults due to the fear of a parent rolling over in their sleeping and accidentally injuring the baby. Further, typical beds are not ordinarily equipped with appropriate gates or railings to prevent an infant from rolling out of bed, which in many instances, would result in injury. Additionally, the transition from the parents' bed to the child's own bed can be highly stressful to the child who has developed a sense of security from sleeping in the parents' bed. In fact, even the transition from a crib to a child bed can be somewhat difficult for a child. This is due to the fact that the child becomes accustomed to a particular sleeping place during the early infant years and slowly begins to identify that familiar sleeping place as a type of safe haven. Therefore, it would be most beneficial to keep the infant in a crib having the proper protective railings, if the crib were capable of being held in place alongside the parents' bed, were capable of eliminating the physical barriers between the parent and the child, were capable of eliminating height differences between crib-mattress and parents' bed and were capable of converting later to a conventional crib and later still to a conventional youth bed.

There are numerous types of cribs known in the art, most of which are particularly designed to prevent a child from falling out of bed. Some cribs are convertible into a youth-type bed by providing for the removal of the side gates when the child reaches the toddler stage. Other cribs include side gates that can be raised and lowered, allowing access to the mattress to facilitate removal of the infant from the crib or to replace the sheets on the mattress. Still, other cribs have been designed as a part of a two-bed unit, wherein the particular crib fits in combination with a matching adult size bed of the same manufacturer.

SUMMARY OF THE INVENTION

The present invention is specifically designed to address the need for a child crib which is specifically structured to accommodate for the transition from the infant stage through the toddler ages. The crib of the present invention includes a headboard unit and foot board disposed at opposite ends of a mattress support platform adjustably connected to the headboard unit and foot board so as to extend substantially horizontally therebetween. A crib mattress is placed on top of the mattress support platform. Opposite side gates extend between the headboard unit and foot board on opposite sides of the mattress and include a fixed side gate on one side and a removable side gate on the opposite side.

During the early infant stages, the crib of the present invention would be placed alongside of the parents' bed with the one side gate removed and the crib mattress adjusted to a height even with the height of the mattress on the parents' bed. This is achieved by raising or lowering the mattress support platform accordingly. In order to anchor the interconnection of the crib with the parents' bed, an apron extends from the mattress support platform on the open side of the crib and is specifically adapted for placement in sandwiched relation between the mattress and mattress support of the parents' bed. With the apron fitted therebetween, the weight of the parents and the mattress on their bed will prevent the crib from being inadvertently forced away from its position alongside the parents' bed. The apron further serves to provide a sort of bridge between the crib and parents' bed, preventing objects such as a baby bottle from falling to the floor between the crib and parents' bed.

Another embodiment of the present invention includes the addition of wheel assemblies comprising preferably two wheels attached to the crib generally and more specifically to the headboard and foot board thereof. In such capacity, the wheels of the wheel assemblies serve to movably support the crib on any given supporting surface. Brake means are associated with the aforementioned wheel assemblies and more specifically at least one wheel of each wheel assembly includes a braking element attached thereto. The braking element is normally biased into what may be considered a braking position defined by confronting engagement with both the one wheel and the supporting surface on which it is mounted. By virtue of this engagement, the crib is allowed to move in one direction which is preferably towards the adjoining bed but is restricted in its movement away from the adjoining bed in an opposite direction.

A remotely disposed handle serves to activate and more specifically position the brake means and the braking element associated therewith into and out of a braking position. The handle is connected to the braking element by means of an attachment cable or like structure.

The headboard unit includes storage means therein including a plurality of shelves and storage compartments which are conveniently located to enable easy access from the parents' bed. In this manner, items such as diapers, baby powder, formula, and clothing can be easily retrieved without the need for the parent to get out of bed.

As the child progresses through the infant stages, the removable side can be reattached and the crib moved away from the parents' bed, possibly into the child's own room. The child continues to sleep on the same mattress surrounded by largely the same visual surroundings and scents of the same crib in which he had always been sleeping. As the child begins to grow and is able to stand, the mattress support platform can be lowered to increase the distance between the upper surface of the mattress and the top railings and edges of the side gates and headboard and foot board, respectively.

Once the child has entered the toddler stage and is able to climb into and out of bed without falling, both side gates can be removed at which point the crib is transformed into a youth's bed.

With the foregoing in mind, it is a primary object of the present invention to provide a crib which is specifically structured to accommodate for the transition from the early infant stages through the toddler ages.

It is a further object of the present invention to provide a crib which includes a removable side gate to facilitate placement of the crib alongside a parents' bed and wherein the crib mattress is adjustable in height so as to be positionable in co-planar relation with the mattress on the parents' bed.

It is still a further object of the present invention to provide a crib which includes an apron or like structure extending from the crib and adapted to be inserted between the mattress and mattress support of the parents' bed to facilitate interconnection of the crib with the bed.

It is yet a further object of the present invention to provide a crib including storage means therein including shelves and compartments which are conveniently located to provide access to items stored therein from the parents' bed.

It is still another object of the present invention to provide a crib which is specifically adapted to provide for a smooth transition for a child from the early infant stages to the toddler years without requiring the child to change to unfamiliar sleeping quarters.

These and other objects and advantages of the present invention will be more readily apparent in the description which follows and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
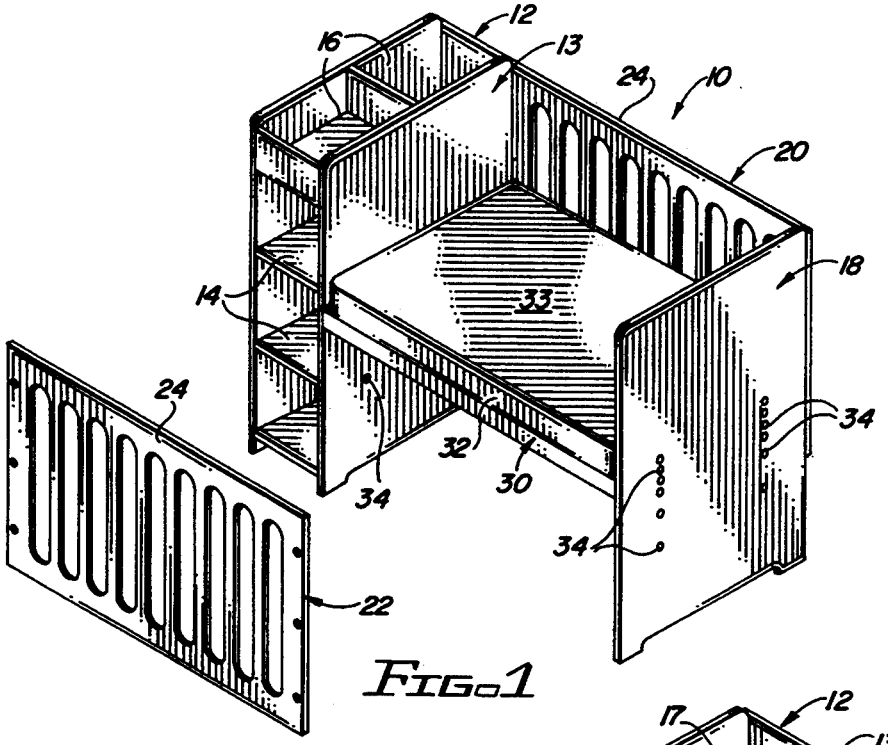
FIG. 1 is an exploded view, shown in perspective, illustrating the crib of the present invention with one side gate removed.

The present invention is directed to a crib, generally indicated as 10, including a headboard unit 12, with headboard 13 and storage means therein including a plurality of shelves 14 and compartments 16. The crib 10 further includes a foot board 8 disposed in spaced, parallel relation to the headboard 13.

Figure 2:
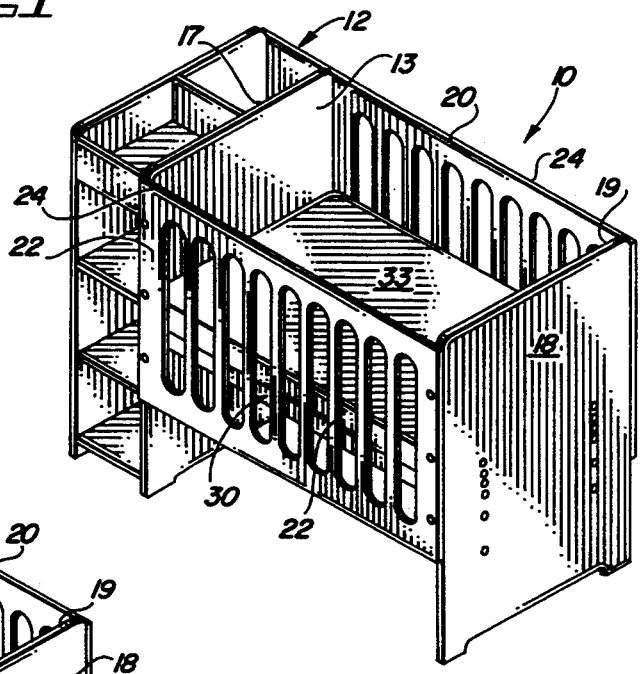
FIG. 2 is a perspective view of the crib of the present invention, shown with both opposite side gates attached and a mattress support platform thereof in a raised position.

As best seen in FIGS. 1 and 2, a fixed side gate 20 is attached to and extends between the headboard unit 12 and foot board 18 on one side of the crib. On the opposite side, a removable side gate 22 is removably attachable to the headboard 13 of the headboard unit 12 and foot board 18 in opposite, parallel relation to the fixed side gate 20. Each of the side gates 20, 22 include a top railing 24 generally co-planar with a top edge 17 of the headboard 13 and top edge 19 of the foot board 18.

A mattress support platform 30 is attachable at opposite ends thereof between the headboard unit 12 and foot board 18 so as to extend substantially horizontally therebetween. The mattress support platform 30 is specifically structured and disposed to support a crib mattress 32 thereon such that an upper surface 33 of the mattress is generally perpendicular to the headboard 13 and foot board 18 in spaced relation below the top railings 24 of the opposite side gates 20, 22. As seen in FIG. 1, a plurality of holes indicated to be at locations and by the numeral 34 are provided in the headboard 13 and correspondingly in the foot board 18 to facilitate selective positioning of the mattress support platform 30 relative to the top railings 24 and top edges 17, 19 of the headboard and footboard and in the headboard 13 and foot board 18 to facilitate selective positioning of the mattress support platform 30 relative to the top surface of the mattress of a parents' bed 110. The holes 34 are specifically structured and disposed to receive conventional fasteners such as screws therethrough for attached engagement with the mattress support platform 30. Accordingly, the mattress support platform is raised and lowered so as to be properly aligned with a particular set of the holes 34 at which point the fasteners can be inserted to secure the platform at the desired height.

Figure 5:
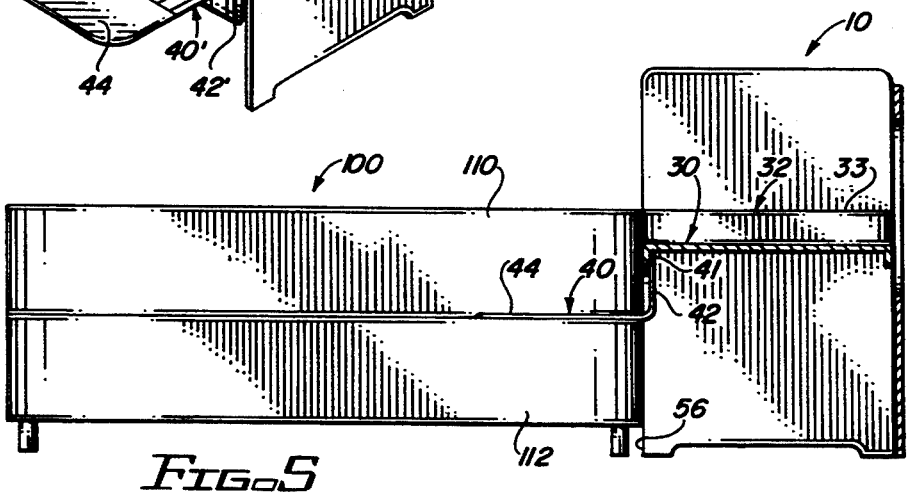
FIG. 5 is a cross-sectional view illustrating placement of the crib of the present invention alongside an adjoining bed.

To facilitate interconnection of the crib 10 with a parents' bed 100, as best illustrated in FIG. 5, an apron 40 is provided. The apron 40 is attached along one edge 41 to the mattress support platform 30 and includes a flexible portion 42 and a rigid portion 44. The apron 40 is specifically structured and disposed for insertion between the mattress 110 and box spring 112 of the parents' bed 100 such that relative movement of the crib 10 and bed 100 is prevented. The flexible portion 42 of the apron 40 allows for bending when the mattress support platform 30 is not co-planar with the top of the box spring 112, as illustrated in FIG. 5. The rigid portion 44 is specifically designed to facilitate insertion of the apron 40 between the mattress 110 and box spring 112. Once attached, the level of the mattress support platform 30 can be adjusted such that the upper surface 33 of the crib mattress 32 is co-planar with an upper surface of the mattress 110.

Another preferred embodiment is disclosed in FIGS. 6–9 wherein modifications to the subject crib assembly has the additional benefit that the crib can be moved away from the parents' bed or adjacent bed so as to make it easier to make up the adjacent bed. However, as shown in the structure of second preferred embodiment, the crib is restricted from movement away from the parents' bed unless such movement is specifically intended.

Figure 6:
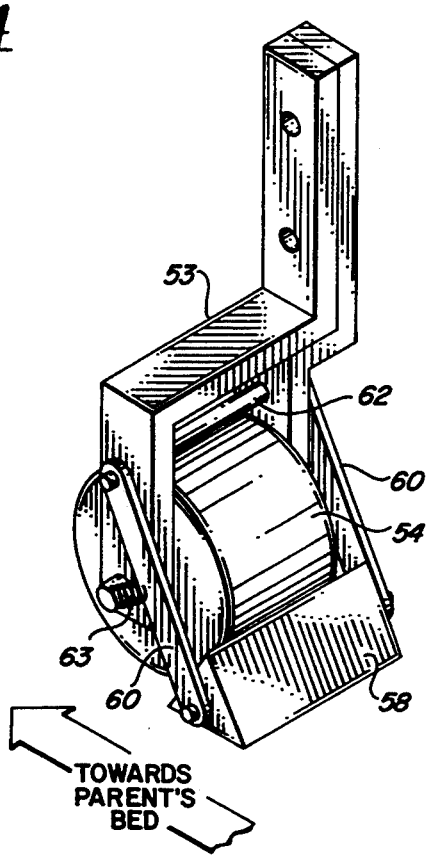
FIG. 6 is a perspective view of one wheel of a wheel assembly.
Figure 7:
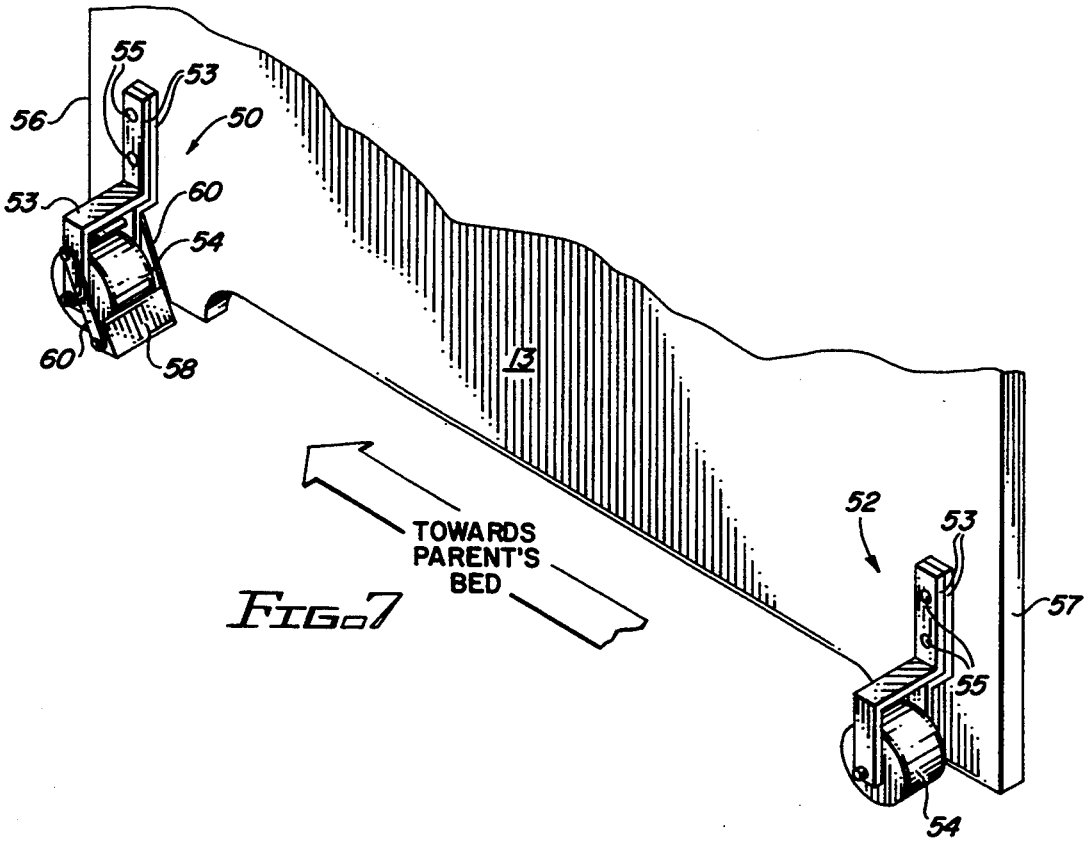
FIG. 7 is a perspective view and partial cutaway of a wheel assembly mounted on the crib structure.

Again, with reference to FIGS. 6–9, the second embodiment comprises a wheel assembly including at least one but preferably two wheel structures indicated in FIG. 7 as 50 and 52. These two wheel structures of each wheel assembly are mounted preferably on the inner surface of the headboard 15 and the foot board 18. Accordingly, the foot board and headboard and therefore the crib itself is movably mounted on any supporting surface such as a floor or like as also best shown in FIG. 7. Each of the assemblies 50 and 52 include a frame structure as at 53 rotatably mounting a wheel member such as 54 in supporting engagement with the floor or ground surface. Conventional connectors such as screws, bolts, etc. may be used and are indicated as 55 to interconnect the frame 53 to the foot board and/or headboard as shown. A preferable position for attachment is that one of the wheel assemblies such as at 50 may be mounted adjacent to or somewhat closer to what may be considered a leading edge 56 of the crib structure wherein the opposite wheel 52 is located somewhat adjacent to the oppositely disposed edge as at 57.

Figure 9:
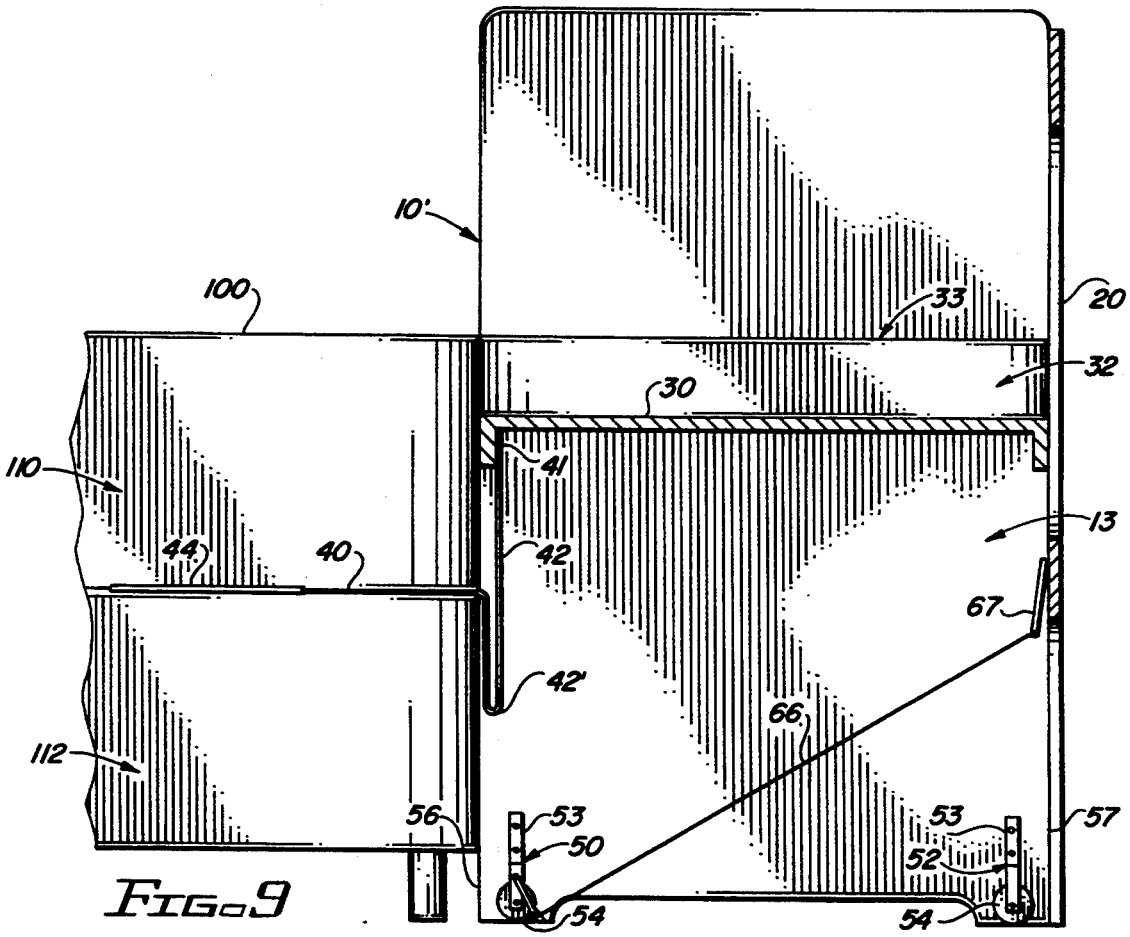
FIG. 9 is a sectional view of the crib structure and adjoining bed structure.

The wheel structure 50 is further modified by including a braking means. This braking means is formed on each of the wheel assemblies 50 located adjacent to what may be considered a leading edge 56 above the headboard and foot board. This leading edge is defined as such because it is located closest to the adjoining or parents' bed as best shown in FIGS. 5 and 9. Accordingly, this "leading" wheel assembly 50 is associated with a braking means. The braking means includes a brake element as at 58 in the form of a brake chock having a substantially wedge-shaped configuration so as to be concurrently positionable into engaging relation with the outer surface of the wheel 54 as well as the supporting surface on which the wheel is mounted. The brake element 58 is supported by at least one but preferably a pair of arms 60 which are pivoted to the frame 53 along a pivot rod 62.

The brake means further includes a biasing means as at 63 in the form of a biasing spring which is disposed and structurally adapted to normally bias the brake chock 58 into its braking position as shown in FIGS. 6 and 7. However, the brake chock or element 58 may be moved out of its braking position such that it does not engage the outer surface of the wheel 54 or the supporting surface or the floor on which the wheels are disposed. This selective positioning of the brake element 58 is accomplished by a brake activating means including a connecting cable as at 66 and a handle 67 mounted on the crib structure at a spaced apart location relative to the wheel assembly 50 associated with the brake means. By virtue of this structure, the connecting cable 66 serves to interconnect the brake handle 67 to the brake arm 60 and/or brake element 58. When manipulated, the handle 67, by virtue of the interconnection of the cable 66, will pivot the arms 60 as well as the brake chock 58 out of its braking engagement into a non-braking engagement. Release of the handle 67 will cause the brake chock to assume its braking position as shown in FIGS. 6 and 7 due to the existence of the biasing spring 63.

Figure 8:
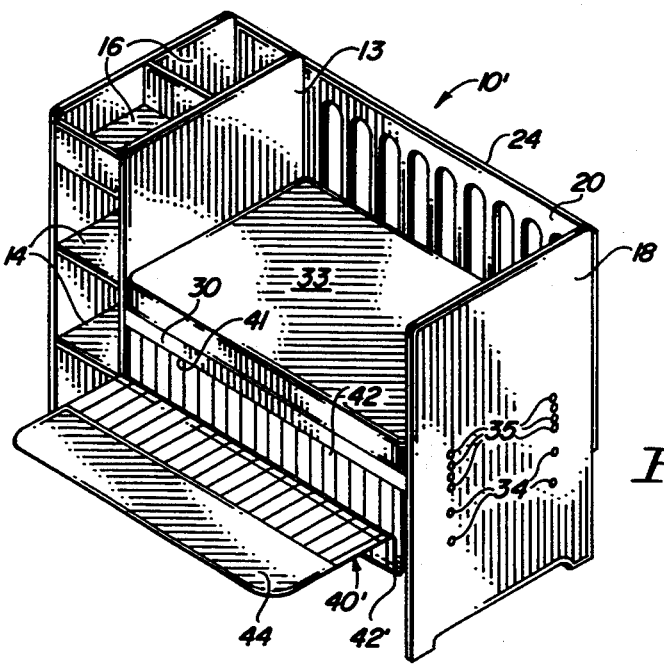
FIG. 8 is a perspective view of another embodiment of the crib structure.

Another structure of this particular embodiment which is primarily associated with the crib assembly 10' when the wheel assembly and brake means is mounted thereon is the existence of a modification of the apron 40' as best shown in FIG. 8. In this embodiment, the apron 40' includes the rigid portion 44 which protrudes underneath the mattress of the adjoining bed (see FIG. 9). However, the apron includes somewhat of an elongated flexible portion 42 so as to allow a fold 42' to exist between the portion of the apron lying underneath the adjoining bed's mattress and that connected to the crib. This allows a selective positioning of the crib assembly away from the adjoining or parents' bed when it is desired to make up this adjoining bed. The existence of the aforementioned braking means will prevent inadvertent movement of the crib away from the adjoining bed unless the brake handle 67 is actuated so as to move the brake from its braking position as shown in FIGS. 6 and 7 into its non-braking position. When the braking means is in its braking position, movement of the crib away from the adjoining or parents' bed is prohibited or seriously restricted. However, the movement of the crib assembly in the opposite direction, towards the adjoining bed, will be permitted due to the specific wedge-shape configuration of the brake chock and its concurrent engagement with the outer surface of the wheel and the floor or supporting surface on which it is mounted.

Figure 3:
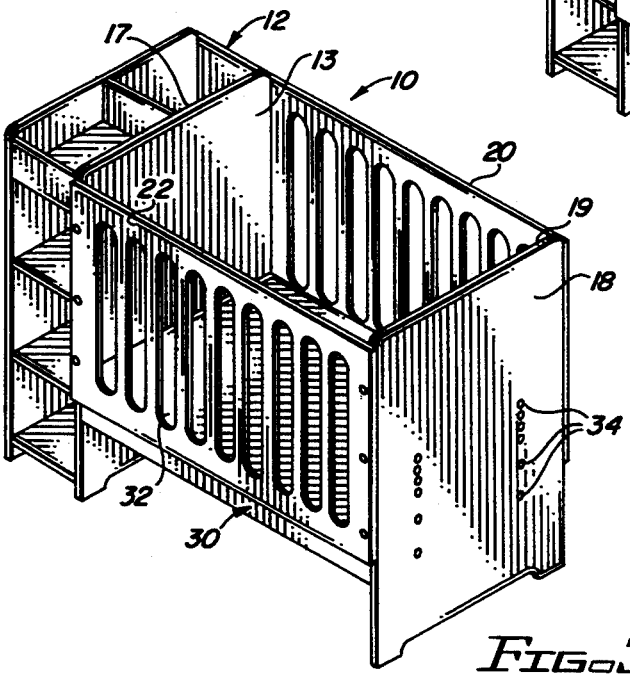
FIG. 3 is a perspective view of the crib of the present invention with the mattress support platform shown in a lowered position.
Figure 4:
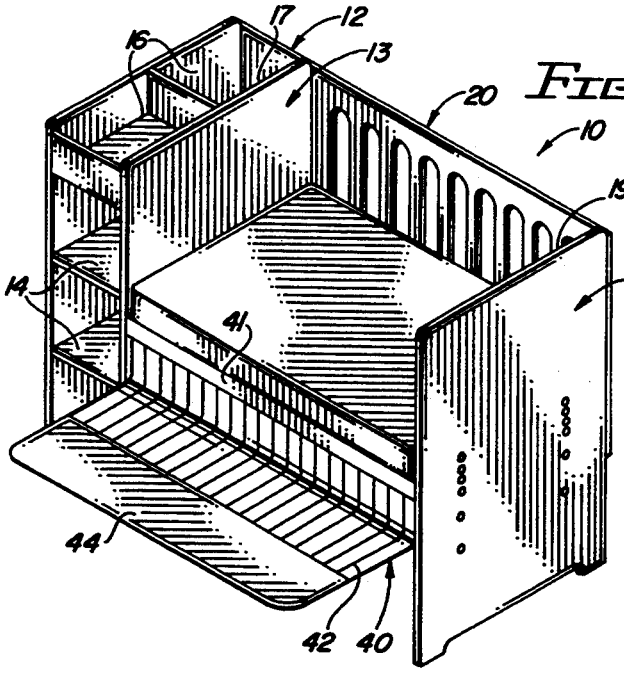
FIG. 4 is a perspective view of the crib of the present invention shown with one side gate removed and an apron thereof extending from the mattress support platform.

When removed from the bed 100, the removable side gate 22 can be replaced to resemble a conventional-type crib. In the infant to earlier toddler stages, the mattress support platform 30 can be raised, as seen in FIG. 2, so that the parent can easily reach over the top railings 24 in order to attend to the child therein. As the child progresses into the toddler stages and is able to stand up, the mattress support platform can be lowered to increase the distance between the upper surface 33 of the crib mattress 32 and the top railings 24 and top edges of the headboard 13 and foot board 18, as seen in FIG. 3.

Now that the invention has been described,

What is claimed is:

1. A child's crib adapted for placement alongside a bed having a mattress and a mattress support, such as a box spring, said child crib comprising:

a headboard unit, including a headboard having opposite vertically extending side edges and a top edge, a foot board including opposite vertically extending side edges and a top edge, a first side gate fixedly attached to corresponding ones of said side edges of said headboard and said foot board respectively so as to extend therebetween in a substantially vertical orientation and including an upper railing extending along a length thereof between said headboard and said foot board, a second side gate removably attachable to corresponding ones of said side edges of said headboard and said foot board respectively, opposite said first side gate, so as to extend therebetween in a substantially vertical orientation and including an upper railing extending along a length thereof between said headboard and said foot board when attached thereto, a mattress support platform having opposite ends and opposite sides and structured and disposed for adjustable interconnection at said opposite ends to said headboard and said foot board respectively so as to extend horizontally therebetween with said first and said second gate disposed along said opposite sides thereof, height adjustment means for adjustably varying a height of said mattress support platform relative to said top edges of said headboard and foot board and said upper railings of said first and second side gates respectively, and an apron attached along one edge thereof to said mattress support platform and outwardly extendable from one of said opposite sides thereof, said apron being structured and disposed for placement in sandwiched relation between the mattress and the mattress support of the bed defining a bridge between said crib and the bed and providing resistance to movement of said crib relative to the bed while further preventing objects from falling therebetween down to an underlying floor surface.

2. A crib as set forth in claim 1 wherein said headboard unit includes storage means therein including a plurality of shelves structured and disposed to accommodate storage of various articles thereon.

3. A crib as set forth in claim 2 wherein said storage means further includes a plurality of compartments for storage of various articles therein.

4. A crib as set forth in claim 1 further including a crib mattress having an upper surface and a lower surface, said crib mattress being sized and configured for supported receipt on said mattress support platform.

5. A crib as set forth in claim 4 wherein said height adjustment means is structured to facilitate controlled adjustment of said mattress support platform so as to position said upper surface of said crib mattress at a level co-planar with a level of an upper surface of the mattress of the bed.

6. A crib as set forth in claim 1 wherein said height adjustment means includes a plurality of vertically spaced apertures on said headboard and said foot board, each of said apertures being positioned and disposed for receipt of a fastening element therein, a plurality of said fastening elements being adapted for supported engagement with said mattress platform so as to effectively attach said mattress support platform to said headboard and said foot board in a generally horizontal orientation therebetween.

7. A crib as set forth in claim 1 wherein said apron includes a substantially flexible fabric portion having a first side edge attached to said mattress support platform and a second side edge integrally attached with a substantially rigid portion, said rigid portion being freely disposed for insertion between the mattress and the mattress support of the bed.

8. A crib as set forth in claim 7 further comprising:

a wheel assembly mounted on each of said headboard unit and said foot board and adapted to movably support said crib on a supporting surface, and brake means connected to said wheel assembly and structurally adapted for restricting movement of said wheel assemblies and said crib in at least one direction.

9. A crib as set forth in claim 8 wherein said brake means is adapted to restrict movement of said wheel assemblies and said crib in a direction away from an adjoining bed and permit movement thereof towards an adjoining bed when said brake means is in a braking position.

10. A crib as set forth in claim 8 wherein said brake means is selectively positionable between a braking position and a non-braking position and is structurally adapted to restrict movement of said crib in one direction and allow movement thereof in an opposite direction when said brake means is in said braking position.

11. A crib as set forth in claim 10 wherein each of said wheel assemblies includes at least one wheel and a corresponding brake means associated therewith, said brake means comprising a braking element movable into and out of a brake position with said one wheel and a biasing means connected to said one wheel and adapted to normally bias said braking element into braking engagement with said one wheel.

12. A crib as in claim 10 wherein said braking element comprises a brake chock having a substantially wedge shaped configuration and positionable into and out of concurrent engagement with said one wheel and a supporting surface on which said one wheel is supported.

13. A crib as in claim 11 wherein said brake means further comprises a brake activating means connected to said braking element, said handle and said cable structurally adapted to move said braking element into and out of said braking position.

14. A child's crib adapted for placement alongside an adjoining bed and having a mattress and a mattress support, such as a box spring, said child crib comprising:

(a) a headboard unit including a headboard, (b) a foot board disposed in opposed, spaced relation to said headboard, (c) a first gate fixedly attached to corresponding ones of said headboard and foot board respectively so as to extend therebetween in a substantially vertical orientation, (d) a second side gate removably attachable to corresponding ones of said headboard and said foot board respectively, and being oppositely disposed to said first side gate so as to extend therebetween in a substantially vertical orientation, (e) a mattress support platform having opposite ends and opposite sides and structured and disposed for adjustable interconnection at said opposite ends thereof to said headboard and said foot board respectively so as to extend horizontally therebetween with said first and second side gates disposed along said opposite sides thereof, (f) height adjustment means for adjustably varying a height of said mattress support platform relative to said headboard and said foot board, (g) a wheel assembly mounted on each of said headboard unit and said foot board and adapted to movably support said crib on a supporting surface, and (h) brake means connected to said wheel assemblies and structurally adapted for restricting movement of said wheel assemblies and said crib in at least one direction, said brake means being selectively positionable between a braking position and a non-braking position and being structurally adapted to restrict movement of said crib in one direction and allow movement thereof in an opposite direction when said brake means are in said braking position.

15. A crib as set forth in claim 14 wherein said brake means is selectively positionable between a braking position and a non-braking position and is structurally adapted to restrict movement of said crib in one direction and allow movement thereof in an opposite direction when said brake means is in said braking position.

16. A crib as set forth in claim 15 wherein each of said wheel assemblies includes at least one wheel and a corresponding brake means associated therewith, said brake means comprising a braking element movable into and out of a braking position with said one wheel and a biasing means connected to said one wheel and adapted to normally bias said braking element into braking engagement with said one wheel.

17. A crib as set forth in claim 16 wherein said braking element comprises a brake chock having a substantially wedge shaped configuration and positionable into and out of concurrent engagement with said one wheel and a supporting surface on which said one wheel is supported.

* * * * *